US009598958B2

(12) United States Patent
Santa

(10) Patent No.: US 9,598,958 B2
(45) Date of Patent: Mar. 21, 2017

(54) AIR MOTOR

(75) Inventor: David Luiz Santa, Jewells (AU)

(73) Assignee: Joe Santa & Associates Pty Limited, Toronto West, New South Wales (AU)

( * ) Notice: Subject to any disclaimer, the term of this patent is extended or adjusted under 35 U.S.C. 154(b) by 747 days.

(21) Appl. No.: 13/636,322

(22) PCT Filed: Mar. 1, 2011

(86) PCT No.: PCT/AU2011/000226

§ 371 (c)(1),
(2), (4) Date: Sep. 20, 2012

(87) PCT Pub. No.: WO2011/140579

PCT Pub. Date: Nov. 17, 2011

(65) Prior Publication Data

US 2013/0008303 A1 Jan. 10, 2013

(30) Foreign Application Priority Data

May 14, 2010 (AU) ..... 2010902095

(51) Int. Cl.

| | |
|---|---|
| ***F04B 45/00*** | (2006.01) |
| ***F01B 19/02*** | (2006.01) |
| ***F01B 7/06*** | (2006.01) |
| ***F01B 25/02*** | (2006.01) |
| ***F01L 15/16*** | (2006.01) |
| *F01L 3/00* | (2006.01) |

(52) U.S. Cl.

CPC ..... *F01B 19/02* (2013.01); *F01B 7/06* (2013.01); *F01B 25/02* (2013.01); *F01L 15/16* (2013.01); *F01L 2003/25* (2013.01)

(58) Field of Classification Search

CPC ..... F01L 15/16; F01B 7/16
USPC ..... 91/329, 393
See application file for complete search history.

(56) References Cited

U.S. PATENT DOCUMENTS

| | | | | |
|---|---|---|---|---|
| 3,741,689 | A | 6/1973 | Rupp | |
| 3,782,863 | A * | 1/1974 | Rupp | F04B 43/0736 417/393 |
| 3,838,946 | A | 10/1974 | Schall | |
| 4,339,985 | A * | 7/1982 | Wilden | F01L 25/06 91/307 |
| 4,854,832 | A | 8/1989 | Gardner et al. | |
| 5,232,352 | A | 8/1993 | Robinson | |
| 5,277,555 | A | 1/1994 | Robinson | |
| 2001/0014291 | A1* | 8/2001 | Nishio | F04B 13/02 417/395 |
| 2011/0142692 | A1* | 6/2011 | Roseberry | 417/395 |

OTHER PUBLICATIONS

PCT International Preliminary Report on Patentability Chapter I (with Written Opinion) from PCT/AU2011/000226 dated Nov. 20, 2012.

* cited by examiner

*Primary Examiner* — Thomas E Lazo
*Assistant Examiner* — Daniel Collins
(74) *Attorney, Agent, or Firm* — Ladas & Parry, LLP

(57) ABSTRACT

An air motor (10) that receives compressed air in order to be driven. The air motor (10) includes a valve assembly (11) with a base (12) of a unitary construction. The base (12) has opposite side faces (13) to which there is sealingly attached caps (14) that in cooperation with flexible diaphragms (15) provide working chambers (15, 16).

18 Claims, 9 Drawing Sheets

AIR MOTOR

CROSS-REFERENCE TO RELATED APPLICATIONS

This application is the U.S. National Stage of International Patent Application No. PCT/AU2011/000226 filed on Mar. 1, 2011, which claims priority to Australian Patent Application No. 2010902095 filed on Mar. 14, 2010, the disclosures of which are hereby incorporated by reference in their entireties.

TECHNICAL FIELD

The present invention relates to motors that use a compressed gas as a working fluid to drive the motor, and more particularly but not exclusively to air motors that receive compressed air to drive the motor.

BACKGROUND OF THE INVENTION

Air motors are known to have a number of working chambers to which compressed gas is delivered to drive pistons at least partly enclosing the working chambers. Valve mechanisms co-ordinate the delivery of compressed air sequentially to the chambers as well as provide for exhausting air from the chambers to cause reciprocation of the pistons. Typically the pistons are connected by a single shaft, with the pistons reciprocating along the axis of the shaft.

A disadvantage of known air motors is the valve assemblies. The valve assemblies consist of a large number of components. This increases the cost in respect of production, and storage of spare parts, and undesirably increase the size of the air motor.

A further disadvantage of known air motors is that the exhaust port and inlet port are part of the main valve assembly. Should either of these ports become damaged during connection or disconnection with associated hosing, then it is necessary to replace the entire valve assembly.

OBJECT OF THE INVENTION

It is the object of the present invention to overcome or substantially ameliorate at least one of the above disadvantages.

SUMMARY OF THE INVENTION

There is disclosed herein an air motor including:

a first working chamber;

a first piston at least aiding in enclosing the first chamber;

a second working chamber;

a second piston at least aiding in enclosing the second chamber;

a central valve assembly including a base of unitary construction with a first valve cavity and a second valve cavity, a first movable valve member slidably located in the first cavity, a second movable valve member slidably located in the second valve cavity, each valve member being movable between a first position and a second position, inlet ducting to deliver compressed gas to the first cavity, outlet ducting to exhaust gas from the second cavity, intermediate ducting between the first and second cavities, and fourth ducting providing for the flow of gas between said second cavity and said chambers;

a connecting member connecting the pistons so that the pistons reciprocate in unison; and wherein said chambers are located on opposite sides of said base so that said base is located between the chambers, said first valve member is moved between the first and second positions thereof by the pistons, and the intermediate ducting provides for the delivery of compressed gas from said first cavity to said second cavity to move said second valve member between the first and second positions thereof so that the valve members are moved between the first and second positions thereof in a co-ordinated manner to provide for the delivery of the compressed gas to the chambers and exhaust of the exhaust gas from the chambers to thereby drive the pistons.

Preferably, the air motor includes:

a first chamber cover at least partly enclosing the first chamber;

a second chamber cover at least partly enclosing said second chamber; and wherein said base has a pair of spaced end faces to which the covers are sealingly connected.

Preferably, said end faces are generally parallel.

Preferably, the air motor includes an inlet member, and an outlet member, the inlet and outlet members being sealingly attached to the base, with the inlet member having an inlet passage communicating with the inlet ducting, and the outlet member having an outlet passage communicating with the outlet ducting.

Preferably, the connecting member has a longitudinal axis, said base has an outlet face adjacent which said outlet member is attached to said base, and an inlet face adjacent which said inlet member is attached to said base, with said outlet face and inlet face being generally parallel, and generally parallel to the axes.

Preferably, said air motor includes a pair of flexible diaphragms, each diaphragm being operatively associated with a respective one of the covers and a respective one of pistons to enclose a respective one of the chambers.

Preferably, each valve member has a longitudinal axis along which the valve member moves linearly between the first and second positions thereof, with the longitudinal axes of the valve members being parallel.

Preferably, the faces are generally perpendicular to the longitudinal axes.

Preferably, said base has a passage within which the connecting member is slidably located, with the connecting member and a connecting member passage having a longitudinal axis generally parallel to the longitudinal axes of the valve members.

Preferably, each diaphragm abuts its respective piston, and the air motor includes a pair of clamp members, each clamp member securing a respective one of the diaphragms to a respective one of the pistons so that each diaphragm is located between its respective piston and clamp member.

Preferably, wherein the motor further includes a further duct, said further duct being provided to connect the first and second working chambers, with a weakened portion rupturing to provide for connecting of the chambers via said further duct should pressure in either of the working chambers exceed a predetermined pressure.

Preferably, when the weakened portion is a weakened portion in each diaphragm.

BRIEF DESCRIPTION OF THE DRAWINGS

A preferred form of the present invention will now be described by way of example only with reference to the accompanying drawings wherein.

DETAILED DESCRIPTION OF THE PREFERRED EMBODIMENT

Figure 1:
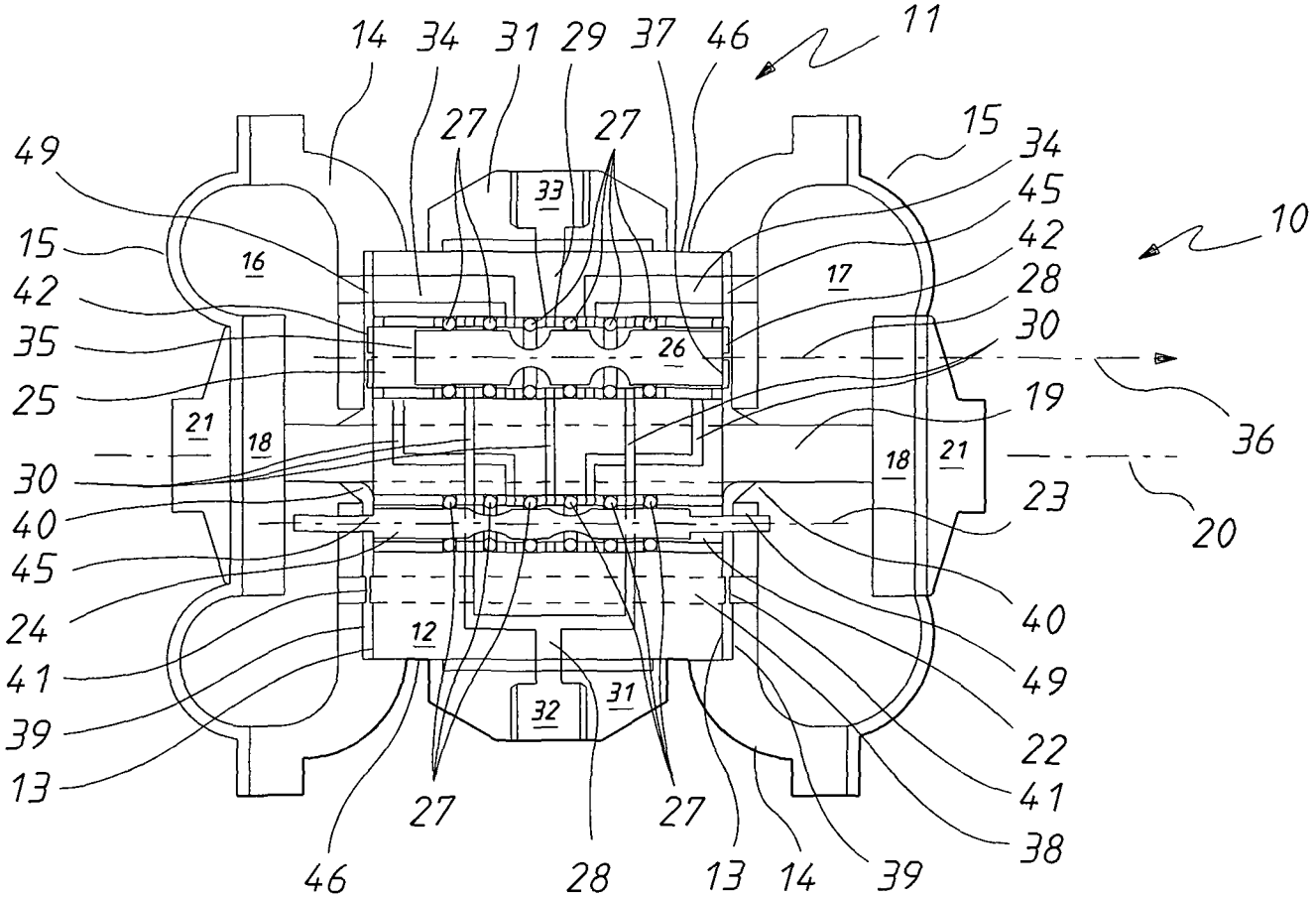
FIG. 1 is a schematic sectioned top plan of an air motor.

In the accompanying drawings there is schematically depicted an air motor 10. The air motor 10 receives compressed air in order to be driven. The air motor 10 includes a central valve assembly 11 including a base 12. Preferably the base 12 is of a unitary construction, that is it is formed of a single piece. The base 12 has opposite side faces 13 to which there are sealingly attached caps (covers) 14 that in co-operation with flexible diaphragms 15 provide working chambers 16 and 17. Each of the diaphragms 15 has secured to it a piston 18, with pistons 18 being connected by a piston rod (connecting member) 19 so that the pistons 18 reciprocate linearly in unison along the longitudinal axis 20 of the piston rod 19. To aid in securing each diaphragm 15 to its associated piston 18 there is provided a clamp member 21. The piston rod 19 extends through passage 48. The axis 20 is also the longitudinal axis of the passage 48.

Each diaphragm 15 has a portion abutting the adjacent piston 18 that effectively forms part of the piston 18.

The faces 13 are generally parallel but spaced along the axis 20 and generally perpendicular thereto.

The base 12 has a first cavity 22 having a longitudinal axis 23 (generally parallel to the axis 20) within which there is located a movable valve member 24, and a second cavity 25 within which is a movable valve member 26.

Extending between the members 24 and 26 and surfaces of the base 12 surrounding the members 24 and 26 are seals 27.

The cavity 25 has a longitudinal axis 51 along which the member 26 moves, with the axis 51 generally parallel to the axis 20.

The base 12 includes inlet ducting 28, exhaust ducting 29, and intermediate ducting 30. The inlet ducting 28 communicates with an inlet port member (inlet member) 31 providing a threaded passage 32 that would typically be threadably engaged with a high pressure hose via which compressed air is delivered to the motor 10. The outlet ducting 29 communicates with an outlet port member (outlet member) 50 having a threaded outlet passage 33 that would be typically attached to a muffler and via which exhaust air gas exits the motor 10. The intermediate ducting 30 connects the first cavity 22 with the second cavity 25.

Fourth ducting 34 connects each of the chambers 16 and 17 with the second cavity 25.

Figure 2:
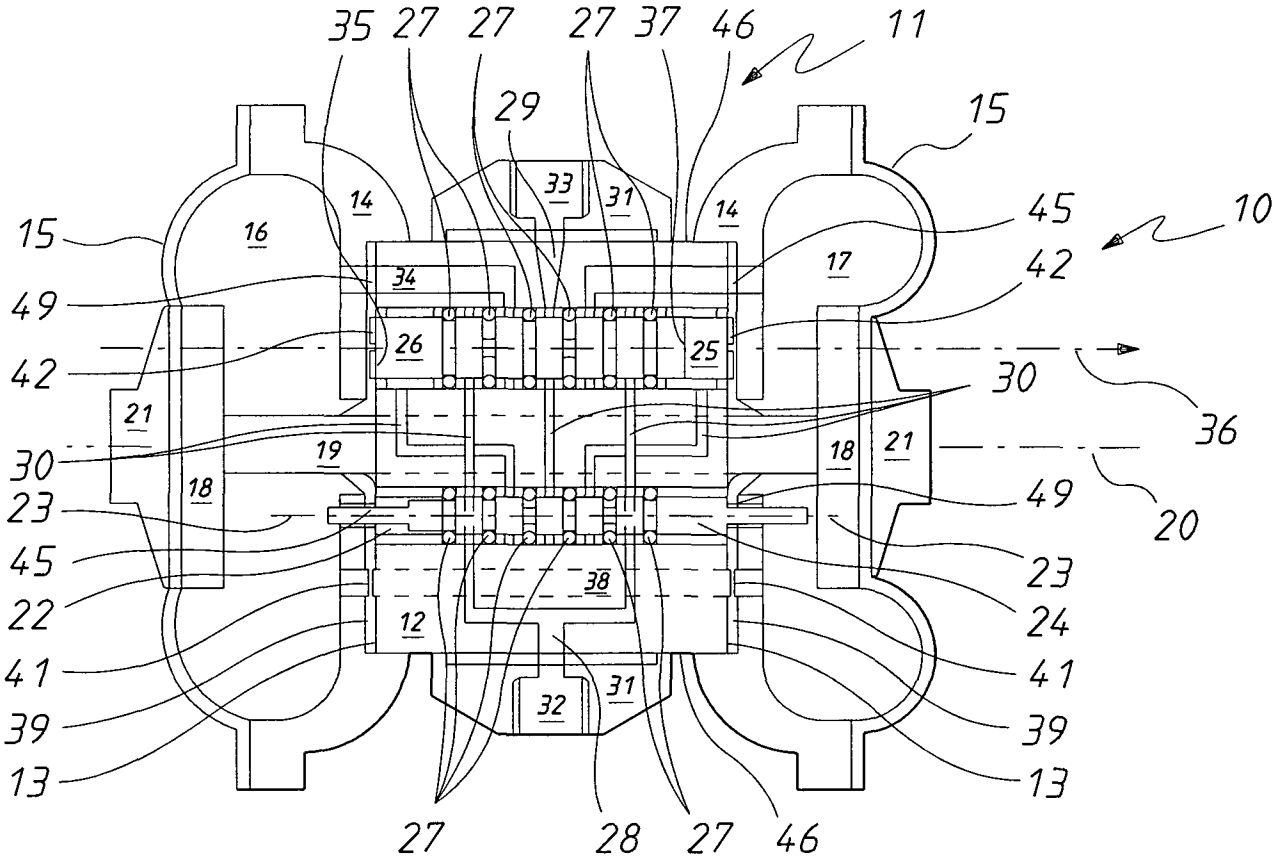
FIG. 2 is a further schematic sectioned top plan of the air motor of FIG. 1.
Figure 3:
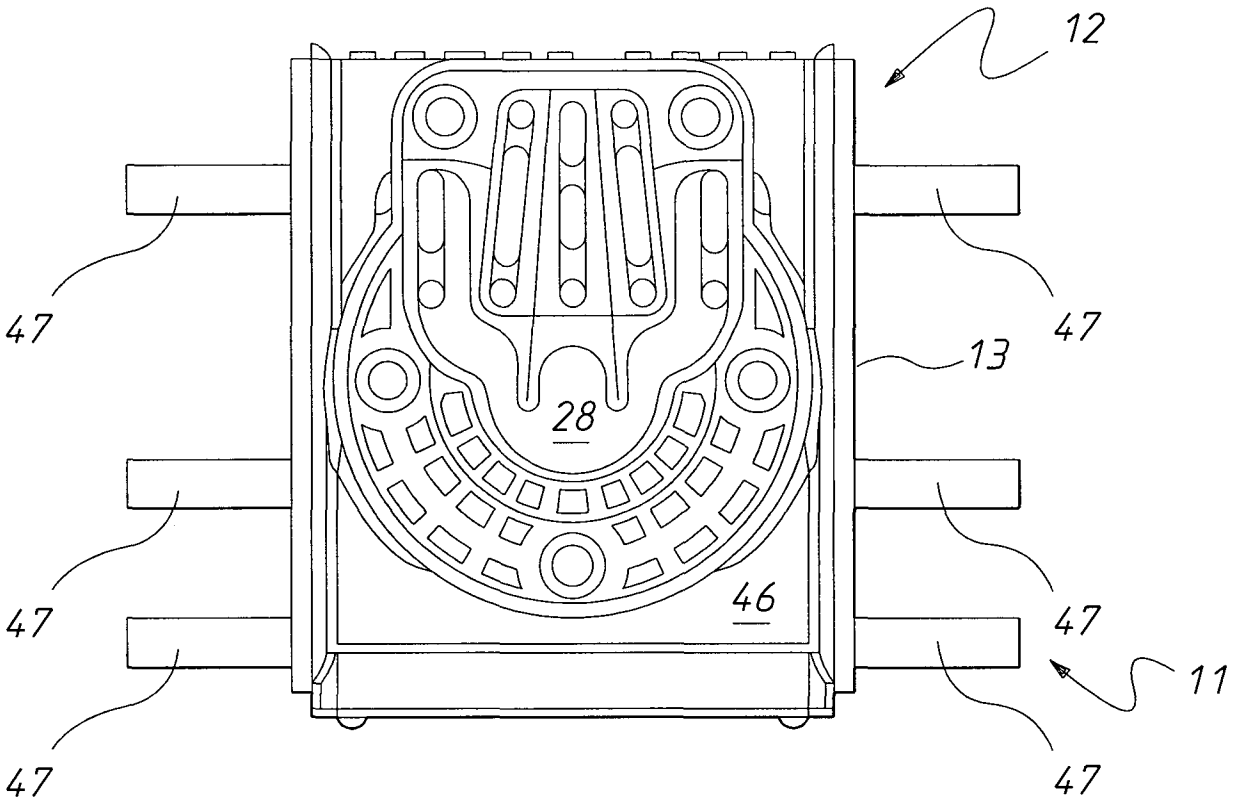
FIG. 3 is a schematic front elevation of an inlet face of a base the central valve of the motor of FIG. 1.
Figure 4:
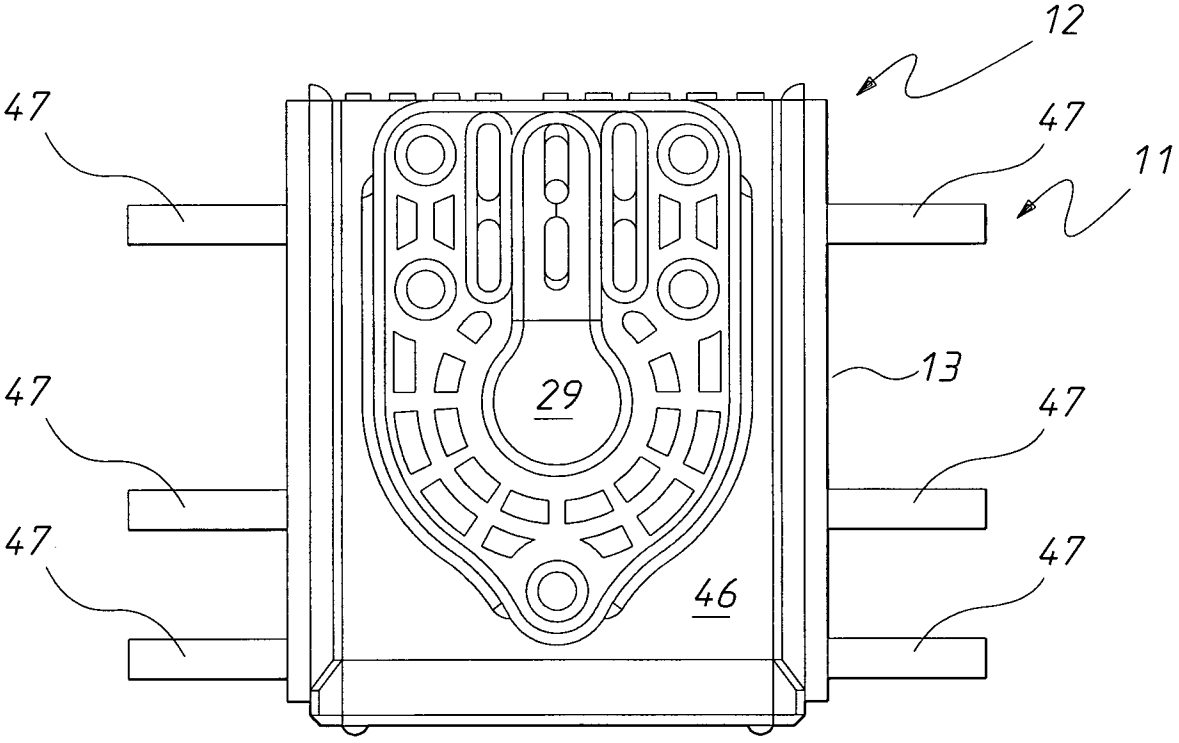
FIG. 4 is a schematic front elevation of an outlet face of the base of FIG. 3.
Figure 5:
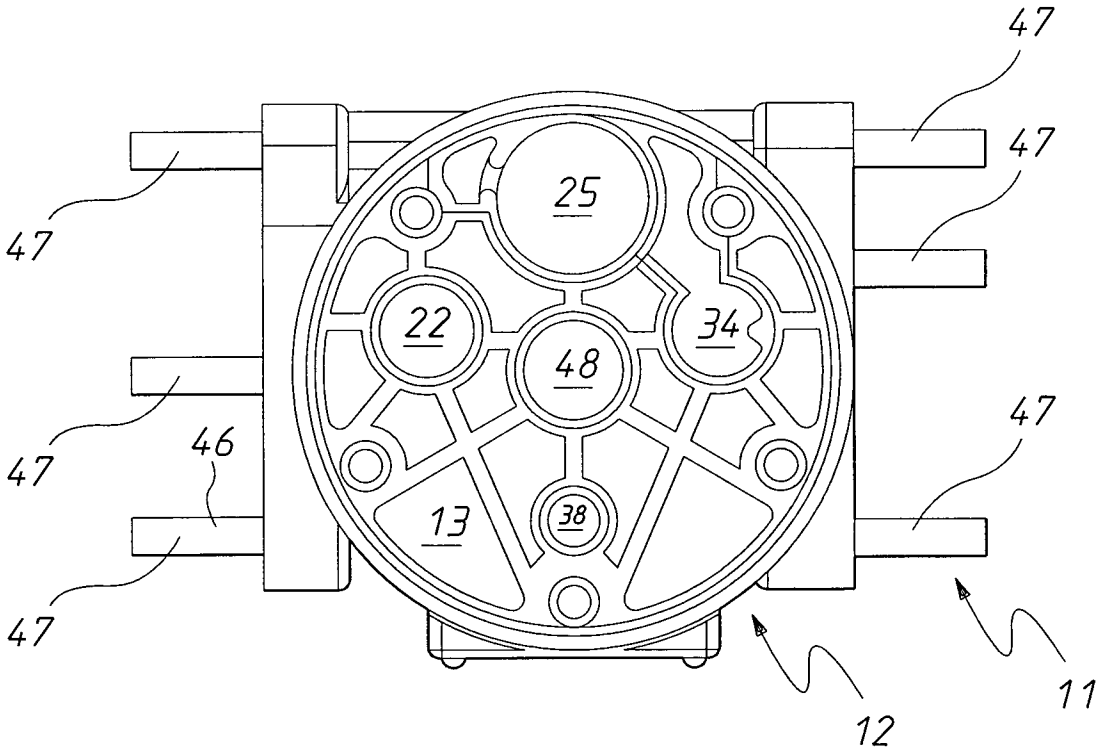
FIG. 5 is a schematic elevation of a side face of the base of FIG. 3.
Figure 6:
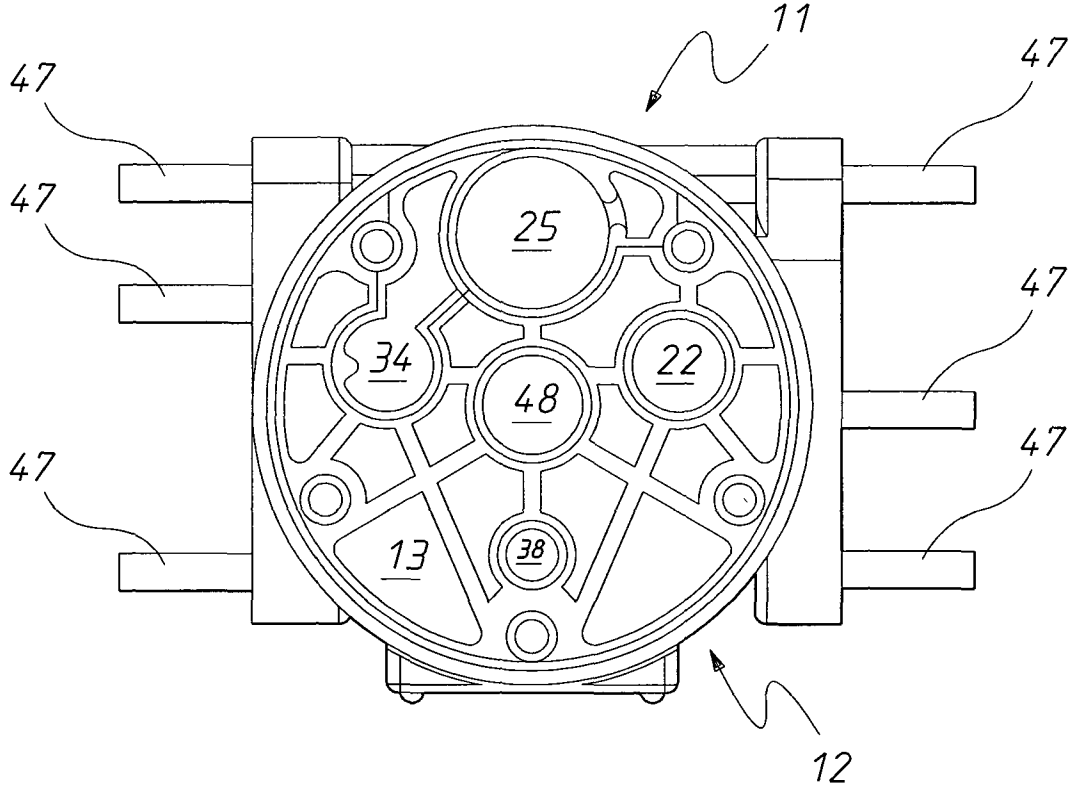
FIG. 6 is a schematic elevation of a further side face of the base of FIG. 3.

As seen in FIGS. 1 and 2, the valve member 24 projects beyond the base 12 so as to extend into each of the chambers 16 and 17.

In operation of the above described air motor 10, compressed air is delivered to the passage 32 from where it is delivered to the cavity 22. Air is simultaneously delivered to the cavity 25 from passage 32 for delivery to the chamber 17 (with reference to FIG. 1). At this time, compressed air is also delivered from cavity 22 to the cavity 25 via intermediate ducting 30 and depressions (ducting) 42 to apply pressure to the end face 35 of the member 26 so that compressed air is delivered to chamber 17. The compressed air in the chamber 17 forces the piston 18 in the direction 36. As the pistons 18 are connected by the rod 19, ultimately the piston of the chamber 16 engages the end of the valve member 24 and forces it in the direction 36. This configuration is now shown in FIG. 2. In this configuration compressed air is then redirected to the chamber 16 to cause movement of the piston rod 18 in a direction opposite the direction 36. Simultaneously air is directed via valve member 24 away from the end face 35 of valve cavity 25 to the exhaust ducting 29 through valve cavity 22, while air is being directed into the cavity so as to apply pressure to the end face 37 to force the valve member 26 in a direction opposite the direction 36 so that the compressed air from passage 32 is now delivered to the chamber 16. This movement of the valve member 26 also alternately connects the chambers 16 and 17 to the exhaust ducting 29. In particular when compressed air is being delivered to the chamber 16, the chamber 17 is connected to the exhaust ducting 29. However when the chamber 17 receives compressed air, the chamber 16 is connected to the exhaust ducting 29. Accordingly, the valve members 24 and 26 are operated to alternately connect the chambers 16 and 17 to the inlet passage 32 and the exhaust passage 33.

The base 12 includes a fifth ducting 38 that extends between the opposite faces 13.

Figure 7:
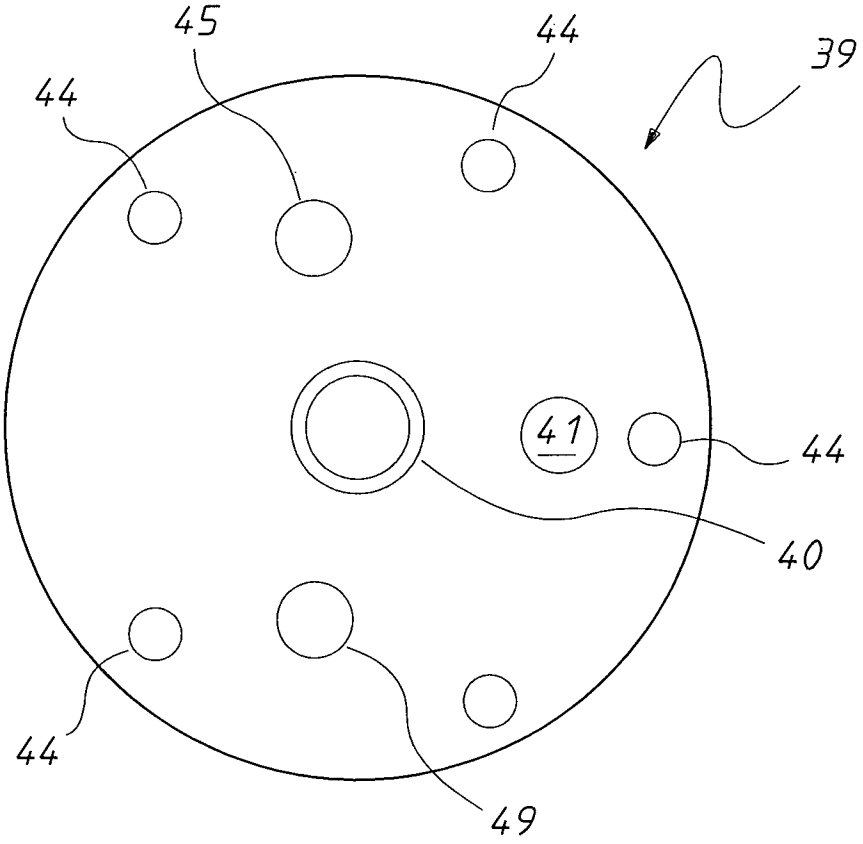
FIG. 7 is a schematic front elevation of a main seal of the air motor of FIG. 1.
Figure 8:
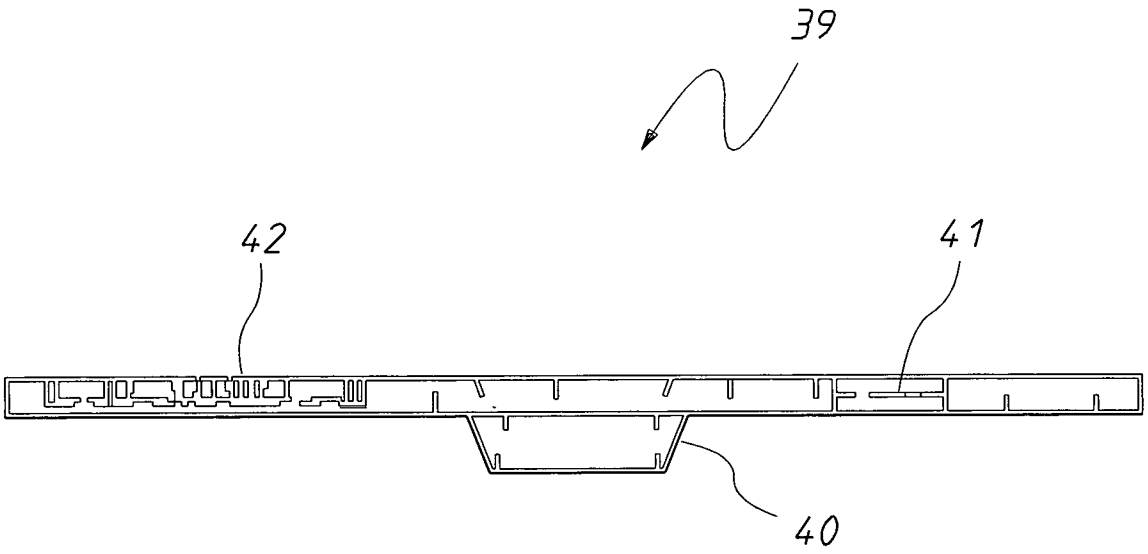
FIG. 8 is a schematic end elevation of the seal of FIG. 7.
Figure 9:
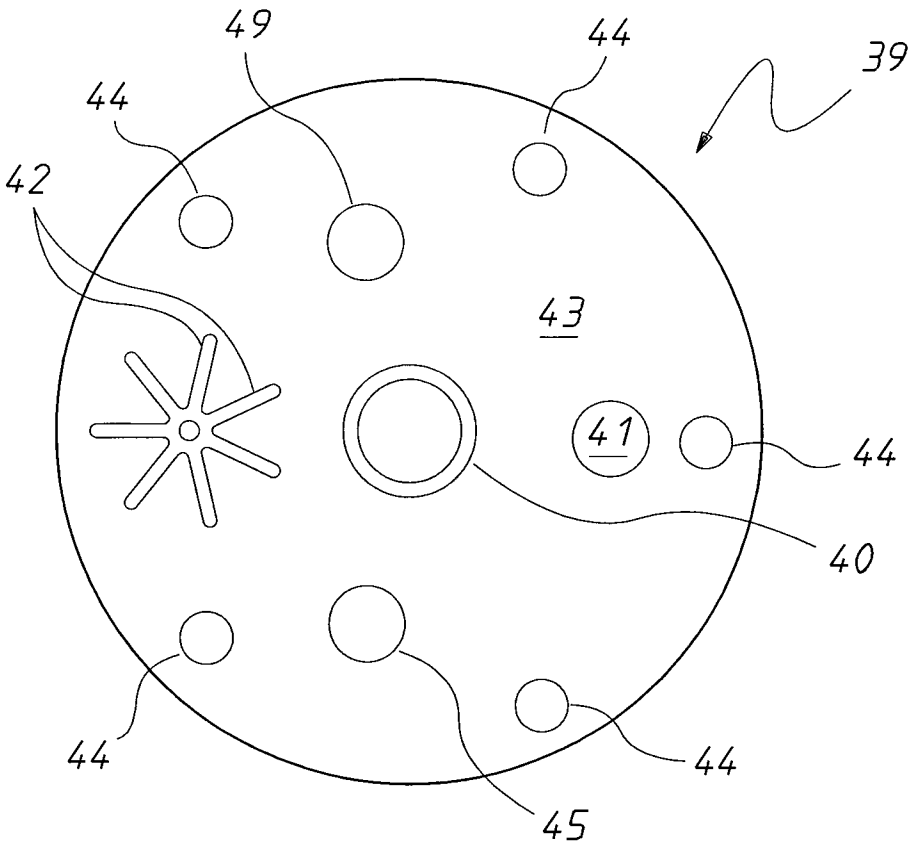
FIG. 9 is a rear elevation of the seal of FIG. 7.

Each cap 14 is sealingly connected to its associated adjacent face 13 by means of a seal 39. This seal 39 is more fully depicted in FIGS. 7, 8 and 9. Each seal 39 includes an annular portion 40 that slidably engages the piston rod 19, as well as having a weakened portion 41 that is aligned with the ducting 38. There is also depressions 42 that provide for the ducting of air to be located adjacent the faces 35 and 37 when the valve member 26 is to be moved. Accordingly the surface 43 of the seal 39 faces the adjacent face 13. Holes 44 provide for threaded bolts 47 to pass therethrough. The bolts 47 pass through the caps 14 and are tensioned to secure the caps 14 to the base 12. The holes 45 and 49 alternately provide for the valve member 24 to extend therethrough, along with aligning with ducting 34 to provide for air flow to and from chambers 16 and 17. On the side of chamber 17, hole 45 provides the air flow while hole 49 allows the valve member 24 to extend therethrough. On the side of chamber 16, hole 49 provides the air flow while hole 45 allows the valve member 24 to extend therethrough.

The base 12 has inlet and outlet faces 46 that are engaged by the members 31 and 50. The faces 46 are generally perpendicular to the faces 13 and are therefore generally parallel to the axis 20.

The ducting 28, 29, 30, 34 and 38 can be formed through the faces 13 and 46.

The above described preferred embodiment has a number of advantages including:

(1) The members 31, being different components to the base 12, can be replaced separately, and without its need to dismantle the caps 14

(2) The base 12 being of a unitary construction;

(3) The provision of the duct 38 and weakened portions 41, that fail should the pressure in either of the chambers 16 or 17 exceed a predetermined pressure, in which case excess pressure is vented to the other chamber 16/17 to be delivered to the exhaust passage 33; and (4) The seal 39 achieves multiple functions, including: sealing between the caps 14 and base 12, sealing around the piston rod 19 with the annular portion 40, assists the flow of air at the ends of member 26 with its depressions 42 while also cushioning the member 26 during its reciprocating movement.

The invention claimed is:

1. An air motor including:

a first working chamber;

a first piston at least aiding in enclosing the first chamber;

a second working chamber;

a second piston at least aiding in enclosing the second chamber;

a central valve assembly including a base of unitary construction with a first valve cavity and a second valve cavity, a first movable valve member slidably located in the first cavity, a second movable valve member slidably located in the second valve cavity, each valve member being movable between a first position and a second position, inlet ducting to deliver compressed air to the first cavity, outlet ducting to exhaust air from the second cavity, intermediate ducting between the first and second cavities, and fourth ducting providing for the flow of air between said second cavity and said chambers, an inlet face to which said inlet ducting extends, and an outlet face to which said outlet ducting extends;

an outlet port member sealingly attached to the base at said outlet face, the outlet port member having an outlet port passage communicating with the outlet ducting so that air leaving the outlet ducting is delivered to the outlet port passage;

an inlet port member sealingly attached to the base at said inlet face, the inlet port member having an inlet port passage communicating with the inlet ducting and to which a supply of compressed air is delivered so that compressed air is delivered to the inlet ducting;

a connecting member connecting the pistons so that the pistons reciprocate in unison; and wherein said chambers are located on opposite sides of said base so that said base is located between the chambers, said first valve member is moved between the first and second positions thereof by the pistons, and the intermediate ducting provides for the delivery of compressed air from said first cavity to said second cavity to move said second valve member between the first and second positions thereof so that the valve members are moved between the first and second positions thereof in a co-ordinated manner to provide for the delivery of the compressed air to the chambers and exhaust of the air from the chambers to thereby drive the pistons.

2. The air motor of claim 1, further including:

a first chamber cover at least partly enclosing the first chamber;

a second chamber cover at least partly enclosing said second chamber; and wherein said base has a pair of spaced end faces to which the covers are sealingly connected.

3. The air motor of claim 2, wherein said end faces are generally parallel.

4. The air motor of claim 1, wherein said outlet face and said inlet face are being generally parallel, and generally parallel to the axes.

5. The air motor of claim 1, further including a pair of flexible diaphragms, each diaphragm being operatively associated with a respective one of the covers and a respective one of pistons to enclose a respective one of the chamber.

6. The air motor of claim 1, wherein each valve member has a longitudinal axis along which the valve member moves linearly between the first and second positions thereof, with the longitudinal axes of the valve members being parallel.

7. The air motor of claim 6, wherein the faces are generally perpendicular to the longitudinal axes.

8. The air motor of claim 7, wherein said base has a passage within which the connecting member is slidably located, with the connecting member and a connecting member passage having a longitudinal axis generally parallel to the longitudinal axes of the valve members.

9. The air motor of claim 5, wherein each diaphragm abuts its respective piston, and the air motor includes a pair of clamp members, each clamp member securing a respective one of the diaphragms to a respective one of the pistons so that each diaphragm is located between its respective piston and clamp member.

10. The air motor of claim 2, further including a pair of flexible diaphragms, each diaphragm being operatively associated with a respective one of the covers and a respective one of pistons to enclose a respective one of the chamber.

11. The air motor of claim 2, wherein each valve member has a longitudinal axis along which the valve member moves linearly between the first and second positions thereof, with the longitudinal axes of the valve member being parallel.

12. The air motor of claim 5, wherein each diaphragm abuts its respective piston, and the air motor includes a pair of clamp members, each clamp member securing a respective one of the diaphragms to a respective one of the pistons so that each diaphragm is located between its respective piston and clamp member.

13. The air motor of claim 2, further including end face seals between each end face and the respective first chamber cover or second chamber cover, the end face seals sealing connecting the end faces and chamber covers.

14. The air motor of claim 1, wherein the motor further includes a further duct, said further duct being provided to connect the first and second working chambers, with a weakened portion of the end face seals rupturing to provide for connecting of the chambers via said further duct should pressure in either of the working chambers exceed a predetermined pressure.

15. The air motor of claim 1, wherein the first movable valve member has opposite end portions engaged by the piston to move the first movable valve member.

16. An air motor including:

a first working chamber;

a first piston at least aiding in enclosing the first chamber;

a second working chamber;

a second piston at least aiding in enclosing the second chamber;

a central valve assembly including a base of unitary construction with a first valve cavity and a second valve cavity, a first movable valve member slidably located in the first cavity, a second movable valve member slidably located in the second valve cavity, each valve member being movable between a first position and a second position, inlet ducting to delivery compressed gas to the first cavity, outlet ducting to exhaust gas from the second cavity, intermediate ducting between the first and second cavities, and fourth ducting providing for the flow of gas between said second cavity and said chambers;

a connecting member connecting the pistons so that the pistons reciprocate in unison; wherein said chambers are located on opposite sides of said base so that said base is located between the chambers, said first valve member is moved between the first and second positions thereof by the pistons, and the intermediate ducting provides for the delivery of compressed gas from said first cavity to said second cavity to move said second valve member between the first and second positions thereof so that the valve members are moved between the first and second positions thereof in a co-ordinated manner to provide for the delivery of the compressed gas to the chambers and exhaust of the exhaust gas from the chambers to thereby drive the pistons, and the motor further includes a further duct, said further duct being provided to connect the first and second working chambers, with a weakened portion of the end face seals rupturing to provide for connecting of the chambers via said further duct should pressure in either of the working chambers exceed a predetermined pressure.

17. The air motor of claim 1, wherein compressed delivered to the working chambers travels from the inlet port, through the first and second cavities and then to the first or second working chambers.

18. The air motor of claim 1, wherein movement of the first movable valve member left causes the second valve movable valve member to move right.

* * * * *